US008297214B2

(12) United States Patent
Lotz

(10) Patent No.: US 8,297,214 B2
(45) Date of Patent: Oct. 30, 2012

(54) REMOTELY OPERATED SUBMERSIBLE VEHICLE

(76) Inventor: Jeffrey Paul Lotz, Ayr (CA)

( * ) Notice: Subject to any disclaimer, the term of this patent is extended or adjusted under 35 U.S.C. 154(b) by 184 days.

(21) Appl. No.: 12/872,796

(22) Filed: Aug. 31, 2010

(65) Prior Publication Data

US 2012/0048172 A1 Mar. 1, 2012

(51) Int. Cl.
*B63G 8/14* (2006.01)

(52) U.S. Cl. ..... 114/330

(58) Field of Classification Search ..... 114/312–315, 114/321–325, 330–342; 440/6, 38, 49, 53, 440/66, 71, 76, 79, 83
See application file for complete search history.

(56) References Cited

U.S. PATENT DOCUMENTS 2,291,940 A * 8/1942 Babcoke ..... 114/316
3,371,635 A * 3/1968 Seeley ..... 114/330
4,377,982 A * 3/1983 Gongwer ..... 114/312
4,455,962 A * 6/1984 Gongwer ..... 114/312
4,571,192 A * 2/1986 Gongwer ..... 440/66

* cited by examiner

*Primary Examiner* — Daniel Venne
(74) *Attorney, Agent, or Firm* — Sinorica, LLC

(57) ABSTRACT

A remotely controlled submersible with a circular profile. A shaft crosses the submersible at the center on the pitch axis that is fixed to the external shell holding the thrusters. From this shaft the framework of the submersible hangs with all of the essential components and any additional weight required gaining the desired buoyancy. A motor such as a servo motor is mounted to the framework and is coupled to a gear, sprocket or pulley that is fixed on the center shaft. When activated the motor rotates the shell of the submersible along with the thrusters to the desired pitch while the internal frame remains low. The design of the submersible external body in relation with the internal body allows the submersible to pitch and maintain stability with a fixed center of buoyancy and center of gravity.

20 Claims, 13 Drawing Sheets

REMOTELY OPERATED SUBMERSIBLE VEHICLE

FIELD OF THE INVENTION

The present invention relates generally to a mechanism for adjusting the pitch of a subsea vehicle, and more particularly, a mechanism that is contained entirely within the body of the vehicle.

BACKGROUND OF THE INVENTION

The present invention improves over the prior art by employing the use of as few as two thrusters and an internal mechanism used to control the pitch from within the shell of the submersible. No ballast system, rudder system, or additional thrusters are required, saving complexity and money while improving reliability. Output shafts through rotary seals or magnetic couplers are minimized to as few as the two essential thrusters, minimizing leak points. The submersible takes on a circular profile while looking at it from the side. A shaft crosses the submersible at the center on the pitch axis that is fixed to the external shell holding the thrusters. From this shaft the framework of the submersible hangs with all of the essential components and any additional weight required gaining the desired buoyancy. A motor such as a servo motor is mounted to the framework and is coupled to a gear, sprocket or pulley that is fixed on the center shaft. When activated the motor rotates the shell of the submersible along with the thrusters to the desired pitch while the internal frame remains low. This system allows the use of conventional low cost components to adjust pitch while remaining safely inside the confines of the submersible. The center of gravity for the submersible does not need to coincide at the same point as the center of buoyancy. However, as with any other submersible, the center of gravity needs to be beneath the center of buoyancy in order to take advantage of equilibrium and the natural righting moment used to remain stable. An additional advantage to this configuration allows a camera and floodlight to be mounted to the center shaft and rotate independently of the body around a center ring window. If the internal frame allows for it, the camera could potentially have an unobstructed 360 degree field of view around the pitch axis.

DETAIL DESCRIPTIONS OF THE INVENTION

All illustrations of the drawings are for the purpose of describing selected versions of the present invention and are not intended to limit the scope of the present invention.

Figure 1:
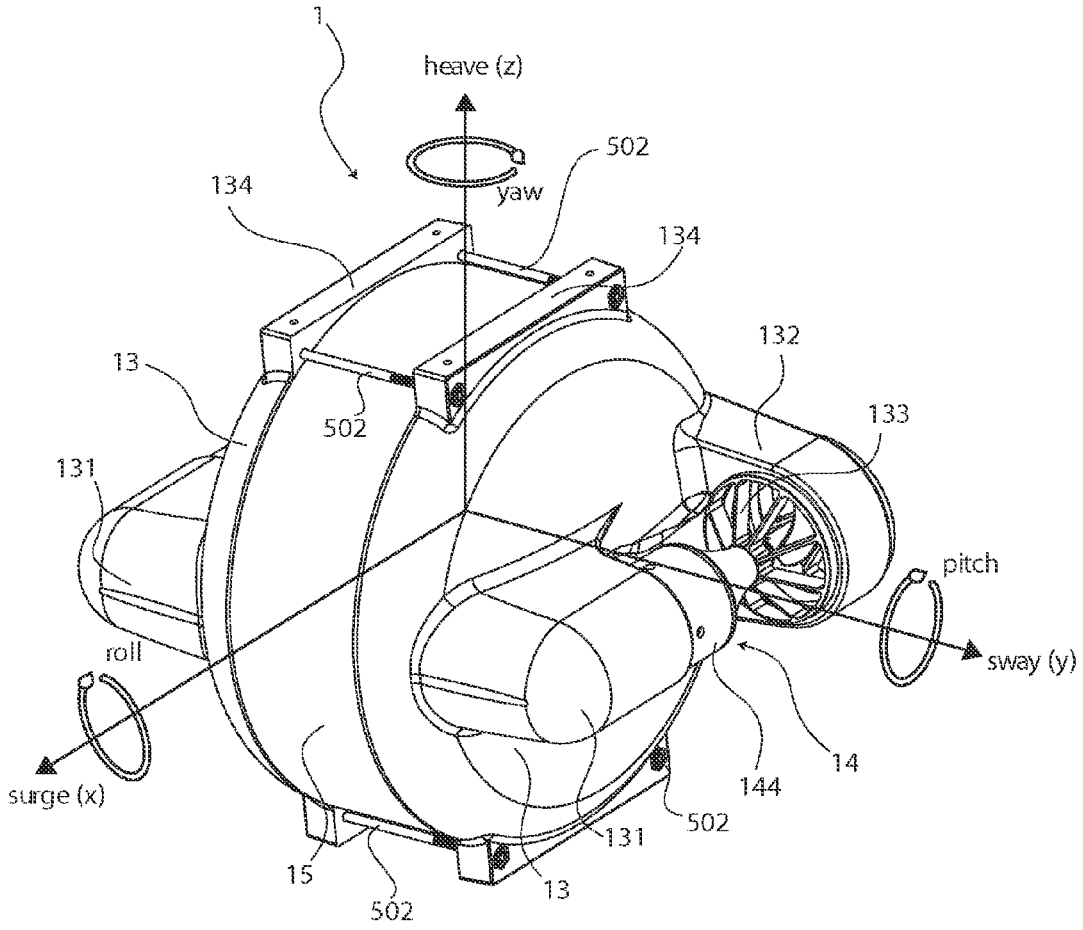
FIG. 1 is a perspective view of the present invention showing the six degrees of freedom.

In reference to FIG. 1, the present invention is a submersible body that possesses the ability to remain stable while pitching. In navel architecture, the terms surge, sway and heave represent translation along the three axes of a vessel, while roll, pitch and yaw represent angular rotation about those axes. Pitch and heave is the freedom of a submersible to move in the vertical plane that differentiates it from a surface ship. It will be this motion and more specifically, the use of pitch, to move vertically in the present invention.

Figure 2:
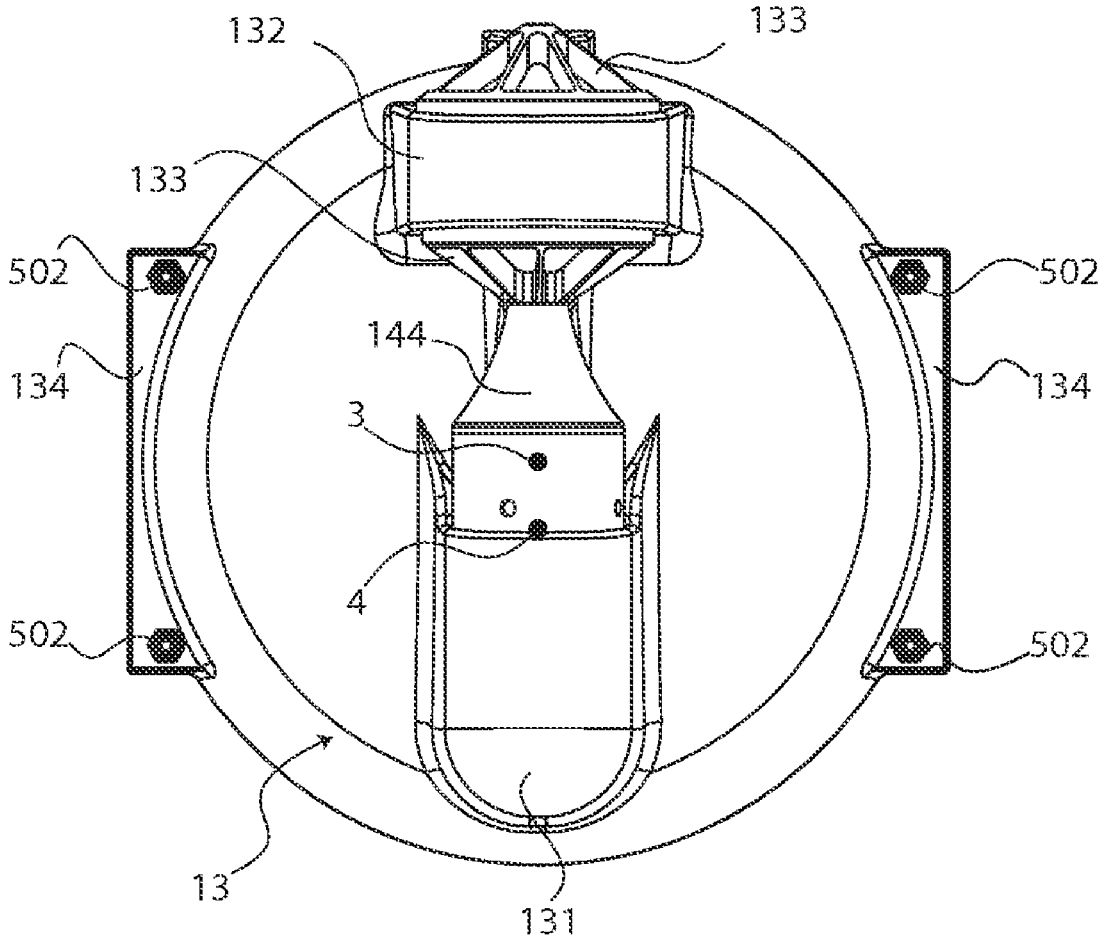
FIG. 2 is a left side view showing the present invention pitching down 90 degrees with the submersible center of gravity remaining in the same position relative to the center of buoyancy.
Figure 3:
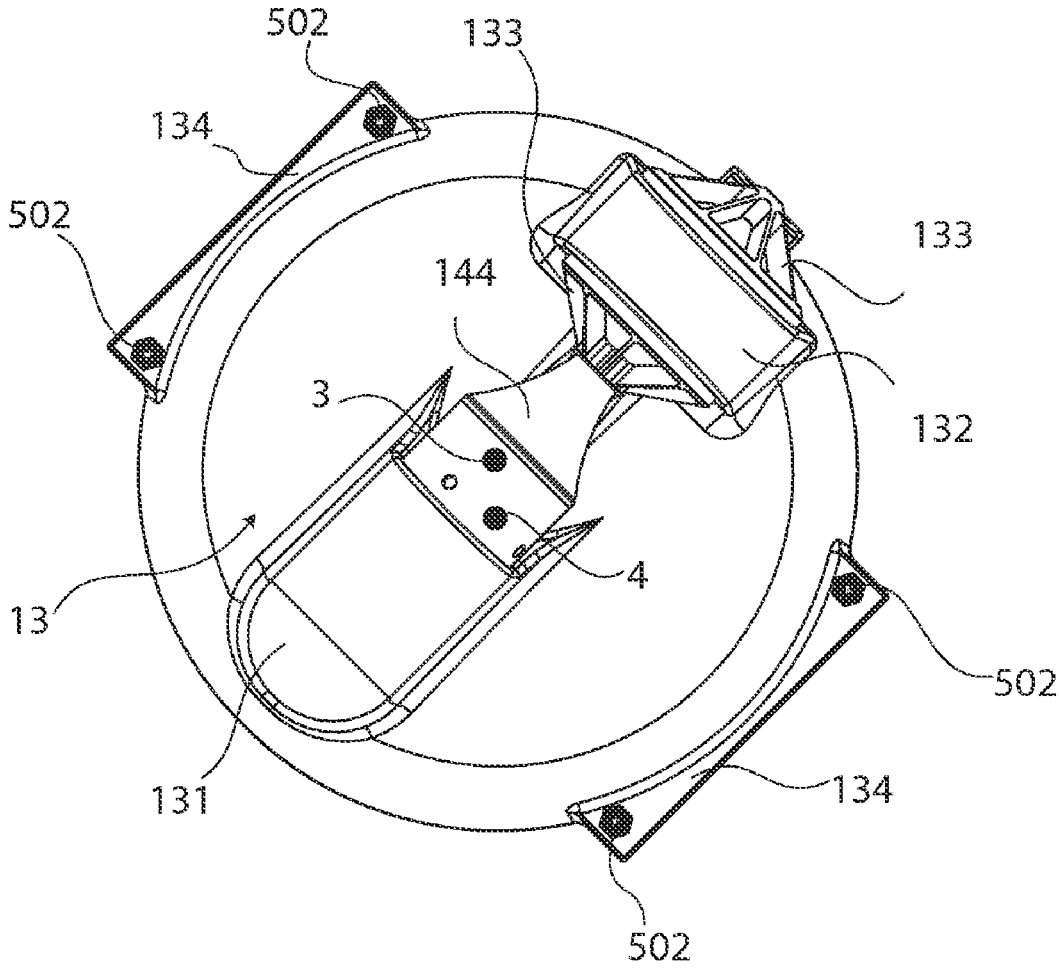
FIG. 3 is a left side view showing the present invention pitching down 45 degrees with the submersible center of gravity remaining in the same position relative to the center of buoyancy.
Figure 4:
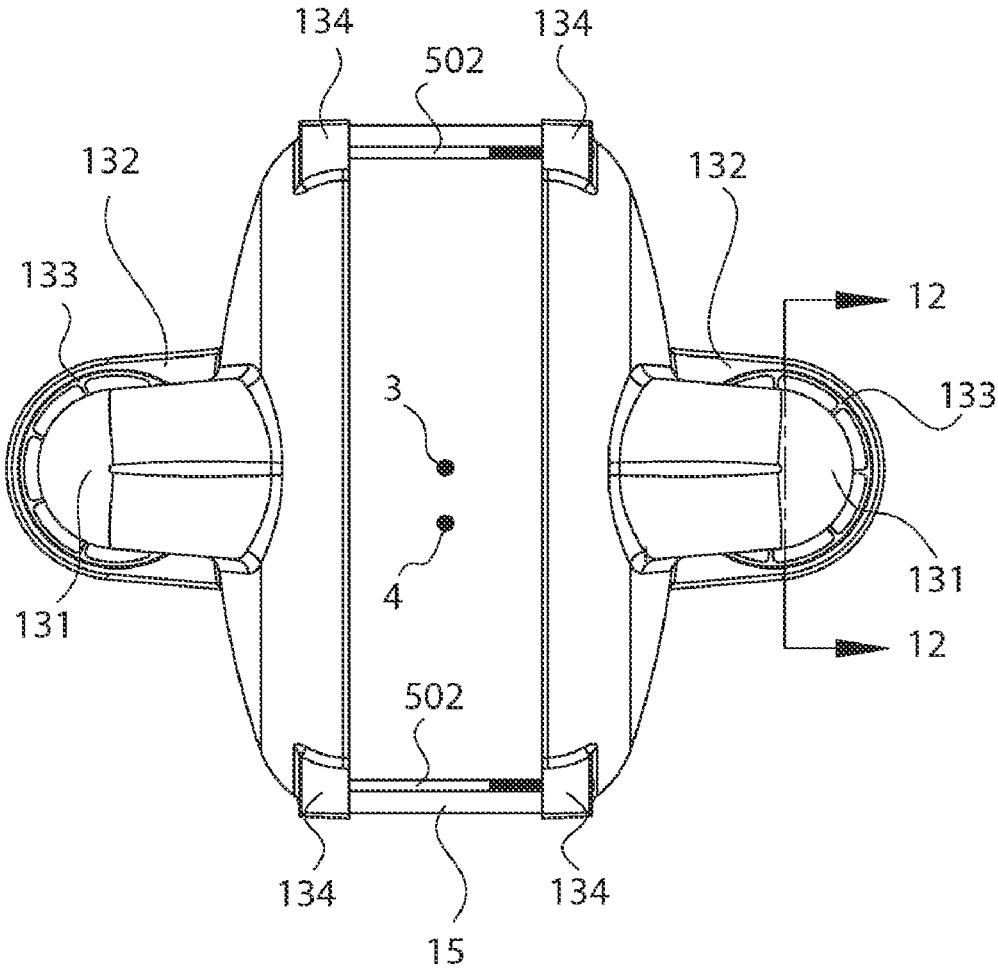
FIG. 4 is a front view showing a plane upon which a section view is taken and shown in FIG. 12. The diagram shows the relative position of the submersible center of gravity to the center of buoyancy.
Figure 5:
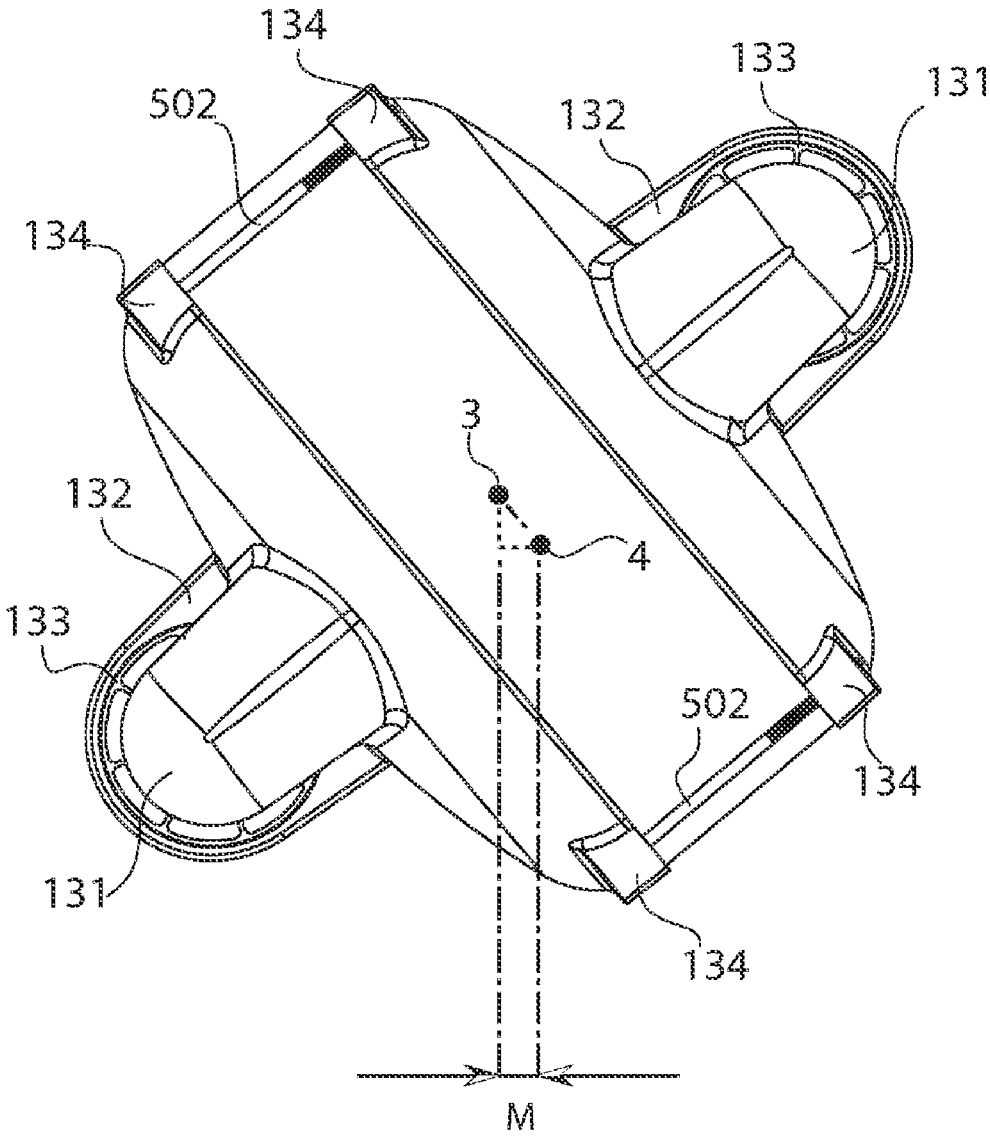
FIG. 5 is a front view of the submersible showing the righting moment acting to re-establish equilibrium bringing the submersible back to an upright position.

Stability is the property of a body that causes it to develop forces, which work to return it to the original position when disturbed from a condition of equilibrium. When the resultant forces and moments acting on an underwater vehicle are zero, it is said to be in a state of equilibrium. The two natural factors that determine the stability of a submerged vehicle is the positional relationship between the center of buoyancy and the center of gravity, along with the magnitude of the effective mass. The center of buoyancy (COB) is the geometric center of volume of the displaced water. The center of gravity (COG) is the effective center of mass of the submersible. In order to become neutrally buoyant, the submersible must have a mass equal to that of the water it is displacing. In order to gain stability, the submersible COG 4 must be as far away from the COB 3 as possible. As shown in FIG. 2, FIG. 3, and FIG. 4, in the case of the present invention as well as the vast majority of submersibles, the submersible COG 4 is located in the lower portion of the vehicle. With any distance between these two points, the submersible will naturally move towards equilibrium, which places the submersible COG 4 directly underneath the COB 3 due to the forces of gravity. It is this natural righting moment that gives the submersible its stability. Illustrated in FIG. 5, the magnitude of the righting moment is determined by the mass of the submersible located at the submersible COG 4 multiplied by its distance, M, from an axis drawn through the COB 3 in the direction gravity is acting.

Figure 6:
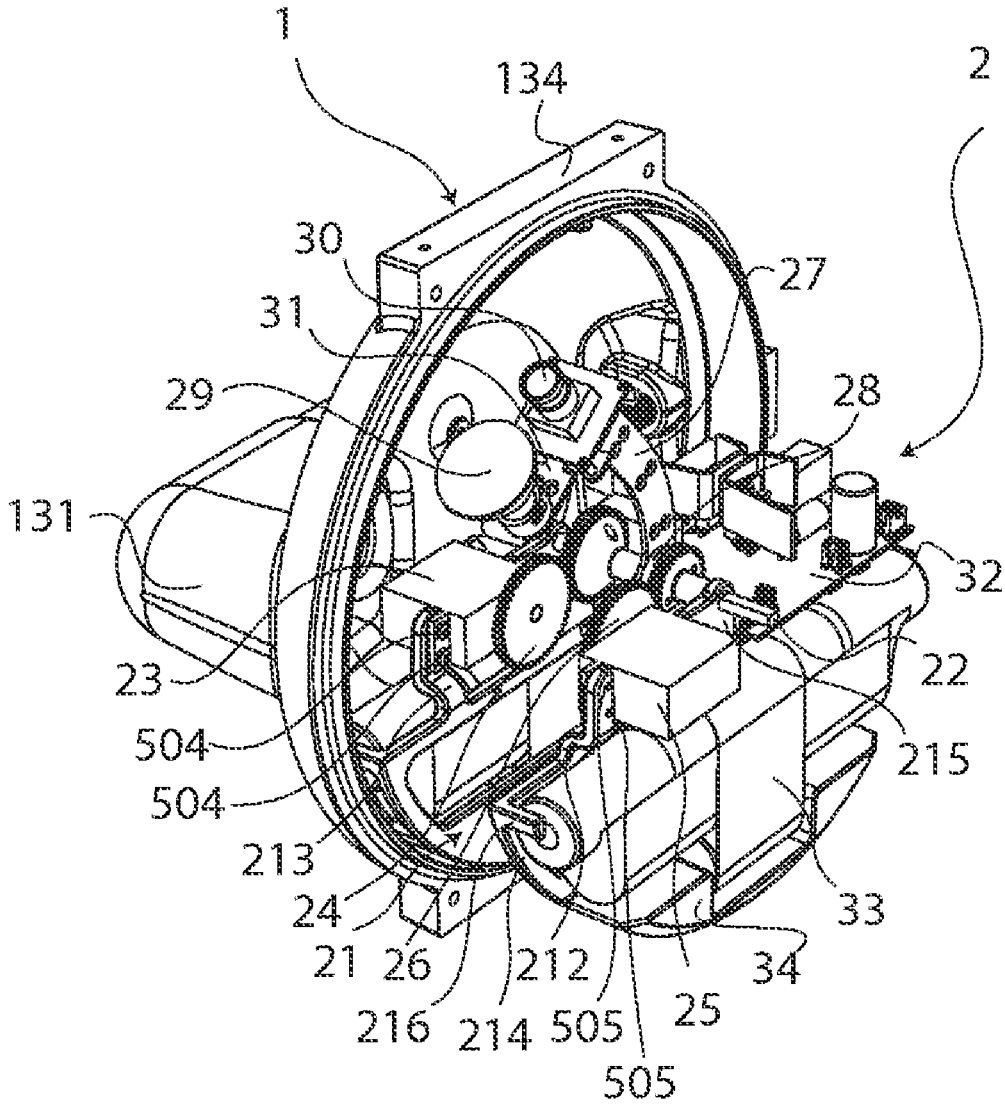
FIG. 6 is a perspective inside view of the present invention excluding one side of the external body and the viewing window.
Figure 10:
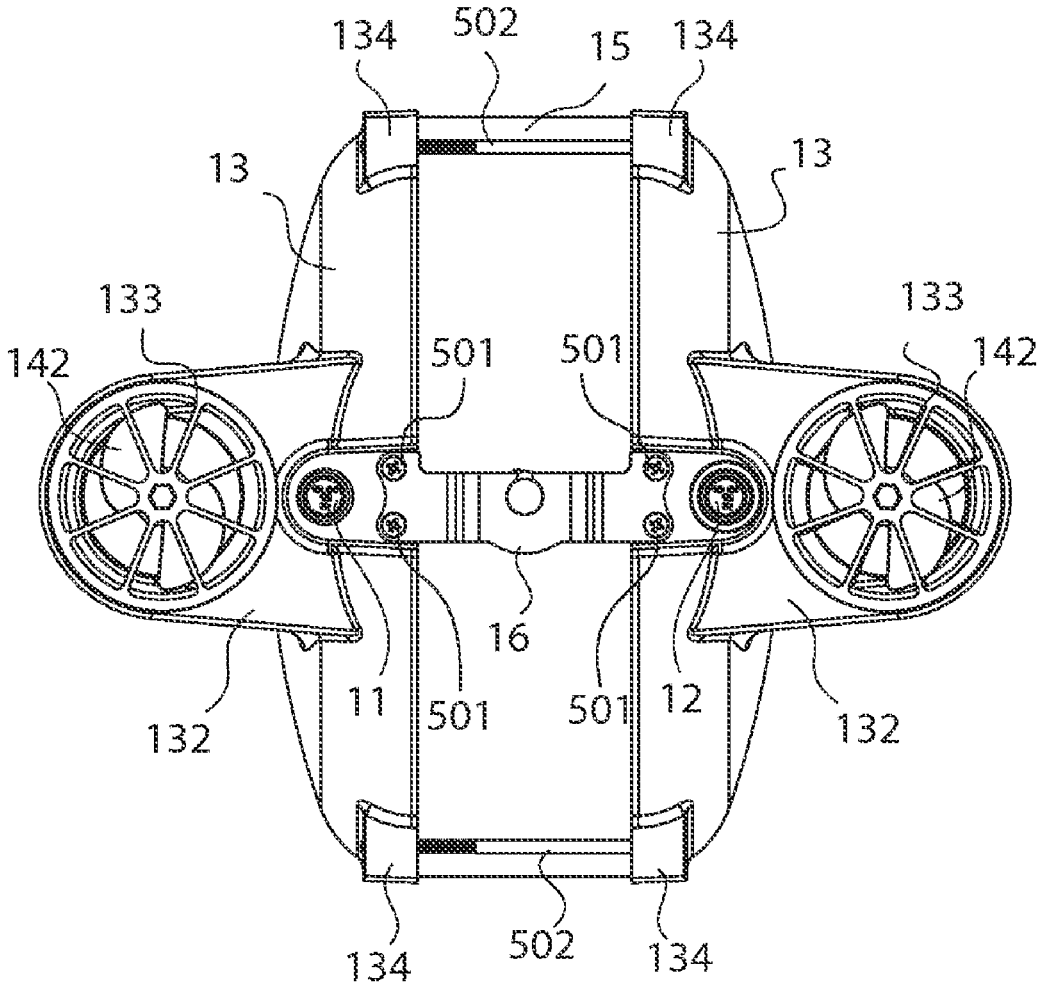
FIG. 10 is a rear view showing the tether support, the charge port, and the control tether port of the present invention.

In reference to FIG. 6 and FIG. 10, the present invention comprises of two main structures including an external body 1 and an internal body 2. The external body 1 comprises of a charge port 11, a control tether port 12, shell bodies 13, thrusters 14, a viewing window 15, a tether support 16, window sealing o-rings 17, and a center shaft 22. The shell bodies 13 and the viewing window 15 together define the structure of the overall external body 1. The shell bodies 13 have circular profiles and comprise of a thruster mount 131, a propeller guarding collar 132, propeller guards 133, and sealing fastener ports 134. The frontal profile of the submersible should be symmetrical across the XY plane to balance the drag on the frontal area of the submersible. With the thrusters in line with the center of drag, no moment is induced on the submersible. There is symmetry across the XZ plane in order to allow the submersible yaw about the Z axis through varying the amount of thrust of opposite thrusters 14. The viewing window 15 is a transparent tube of the same size and radius as the circular profile of the shell bodies 13. The center shaft 22 is connected to the center of the circular profiles between the shell bodies 13. This design allows the submersible to maintain stability and control. The shell bodies 13 are connected to both sides of the viewing window 15. The window sealing o-rings 17 are o-rings that are placed between the viewing window 15 and the shell bodies 13 to seal the connection. The window sealing o-rings 17 ensure that the space within the external body 1 remains water tight. To hold the shell bodies 13 and the viewing window 15 together, sealing fasteners 502 are inserted to secure the corresponding shell bodies 13 together at the sealing fastener ports 134. In the preferred embodiment of the present invention, the submersible will include four sealing fasteners 502 to tighten and hold the bodies together. However, in other future embodiments of the present invention, the submersible may be smaller and will have a single sealing fastener inserted through the pitching axis of the submersible for securing the bodies together. The location of the sealing fastener 502 on the pitching axis will not obstruct the view of the video camera 30. The external body 1 is used primarily to hold out water and to mount the thrusters 14. The viewing window 15, being a tube, will have shell bodies 13 on the right side and the left side. The control tether port 12 is positioned adjacent to the propeller guarding collar 132 and the viewing window 15 on the right shell body. The charge port 11 is positioned adjacent to the propeller guarding collar 132 and the viewing window 15 on the left shell body. The charge port 11 and the control tether port 12 are positioned opposite of each other over the viewing window 15. Between the charge port 11 and the control tether port 12 is connected the tether support 16. The tether support 16 is fastened to the right and left shell bodies 13 by the tether support fasteners 501. The charge port 11 is for connecting to a smart charger 6 to charge the submersible's batteries. The control tether port 12 is used for connection to a game pad controller by a long control tether. The game pad controller allows the user to control the submersible remotely.

Figure 9:
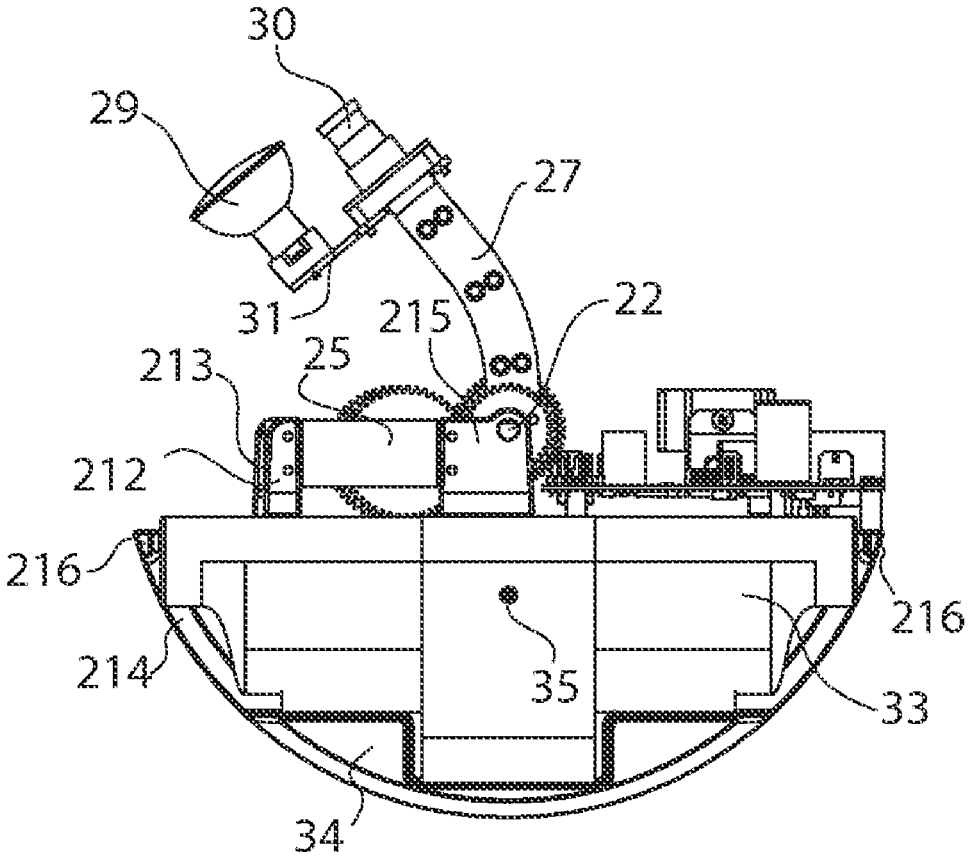
FIG. 9 is a side view showing the second center of gravity of the internal body.
Figure 11:
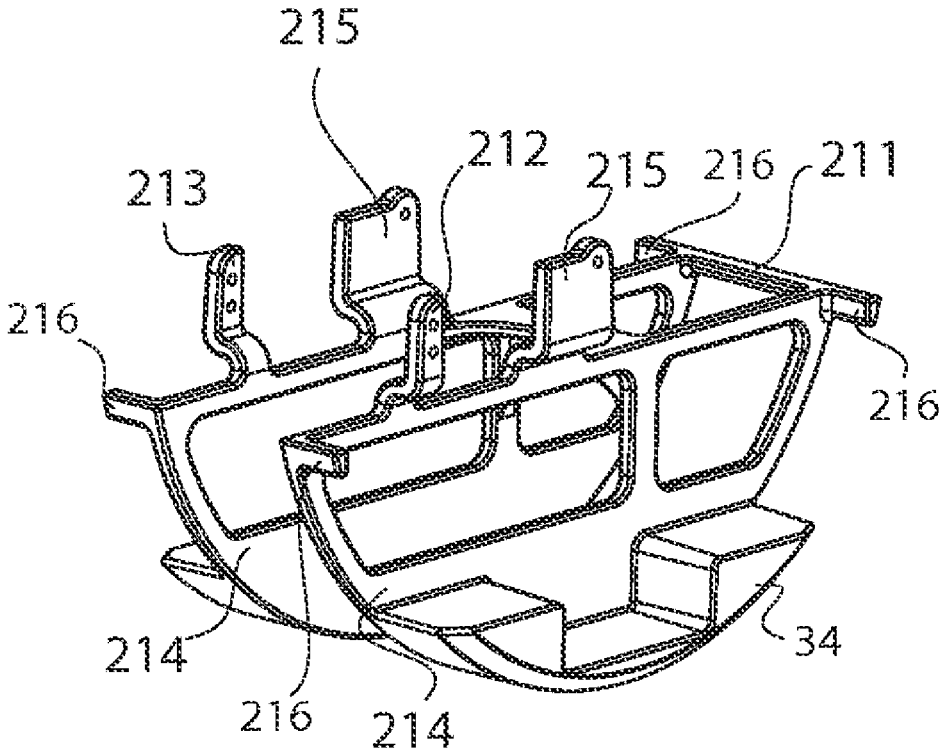
FIG. 11 is a perspective view of the internal frame of the present invention.

In reference to FIG. 6, FIG. 9, and FIG. 11, the internal body 2 consists of all the necessary components to make up the mechanisms for operating the submersible including an internal frame 21, a pitch servo motor 23, a pitch shaft train 24, a camera servo motor 25, a camera train 26, a camera arm 27, a camera shaft mount 28, a flood light 29, a video camera 30, a camera arm mount 31, a control circuit 32, battery packs 33, and weight sets 34. The internal frame 21 is the supporting structure of the internal body 2 that holds all of the internal body 2 components together. Additionally, the internal frame 21 is shaped to have mechanical stops 216 to ensure that the external body 1 does not pivot too far and damage the pitch train system. The internal frame 21 comprises of a circuit board mount 211, a camera servo mount 212, a pitch servo mount 213, a battery mount 214, and a shaft frame mount 215. The internal body 2 hangs downwardly from and is able to pivot about the center shaft 22 at the shaft frame mount 215. The pitch servo motor 23 is fastened onto the pitch servo mount 213 by the pitch servo fasteners 504. The pitch servo motor 23 allows the user to control the pitching of the submersible. To achieve the pitching control, the pitch servo motor 23 is connected to the center shaft 22 by the pitch shaft train 24. The pitch shaft train 24 is able to transfer rotational forces directly to the center shaft 22. The pitch shaft train 24 can be, but is not limited to, a gear set, a belt and pulley system, a chain and sprocket system, or any other suitable systems. With the center shaft 22 directly connected to the external body 1, the activation of the pitch servo motor 23 causes the angle of the external body 1 to change in relation to the internal body 2. This allows the external body 1 to rotate while the internal body 2 remains stationary in the bottom of the circular profile. Once the external body 1 is pitched away from level, the thrust from the thrusters 14 is now utilized to not only gain movement in the surge direction but also the heave direction. The unique configuration of the internal body 2 in relation to the external body 1 along with the circular and symmetrical shape allows the COB 3 and submersible COG 4 to remain in the same position. The internal body 2 will not rotate around the center shaft 22 while the external body 1 holds its position with the submersible COG 4 of the internal frame 21 off set from the COB 3. This causes the submersible to leave the state of equilibrium. The pitching mechanism works entirely within the confines of the external body 1 to force the external body 1 and the propulsion system to pitch to any desired angle. The range of the pitch angle for the submersible could be from a few degrees to a full 360 degrees or even continual pitching. As shown in FIG. 2 and FIG. 3 the submersible can be pitched at any angle while maintaining a constant COB 3 and submersible COG 4 for stability.

Figure 13:
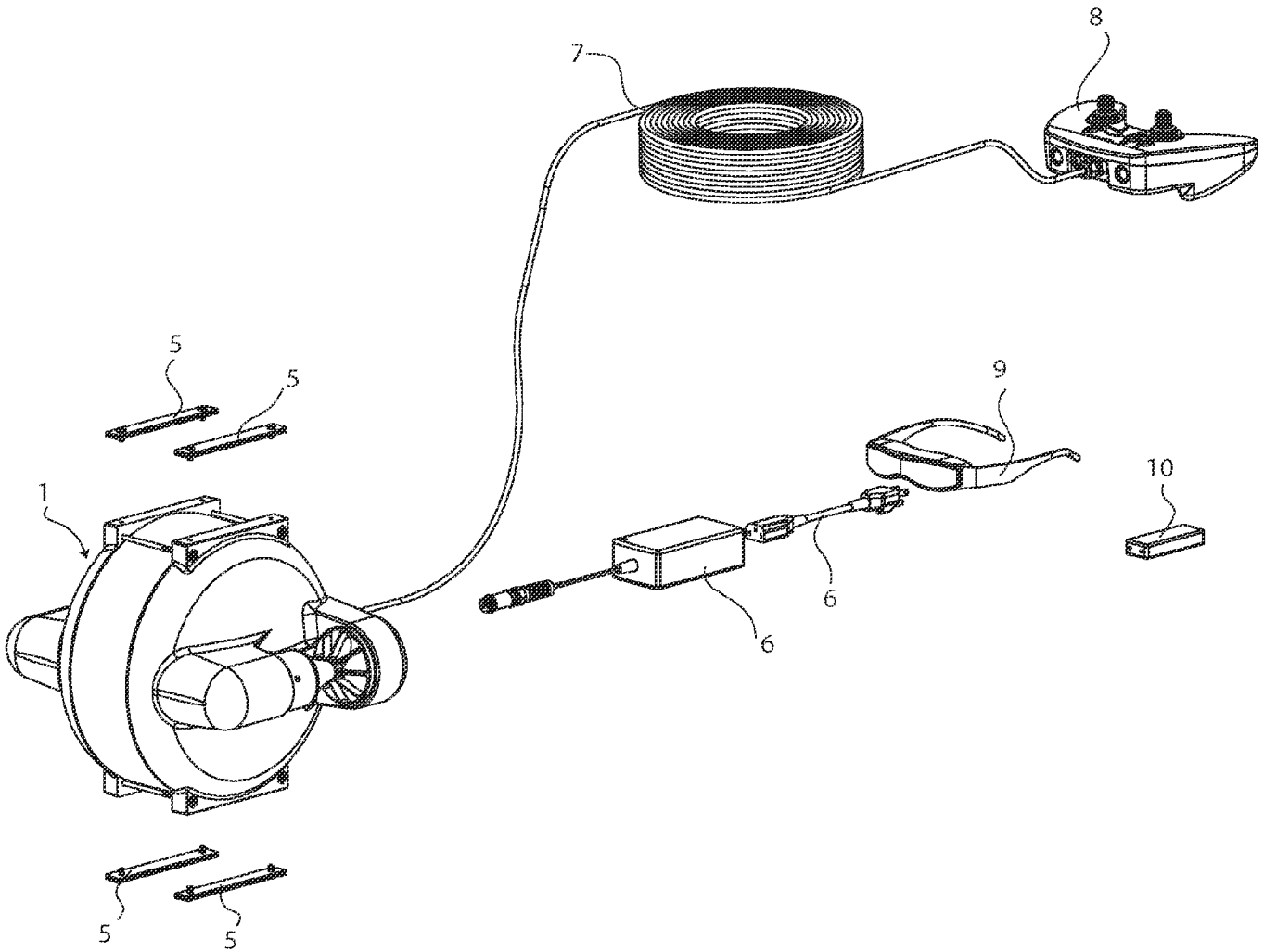
FIG. 13 is a perspective view of the components involved with the present invention allowing the user to control the submersible remotely.

Even with the external body 1 pitched, the internal body 2 will maintain its position. The submersible can also be fitted with the control tether 7 by connection to the control tether port 12 and held by the tether support 16, as shown in FIG. 13. The optimum positioning of the tether support 16 would be the rear of the external body 1 parallel with the thrusters 14 to prevent drag. Additionally, the tether support 16 is also on the same XY plane as the thruster 14 such that no moment is incurred on the submersible when thrusting. This way the control tether 7 will not inflict any moment on the submersible when in motion and will simply trail behind.

Figure 7:
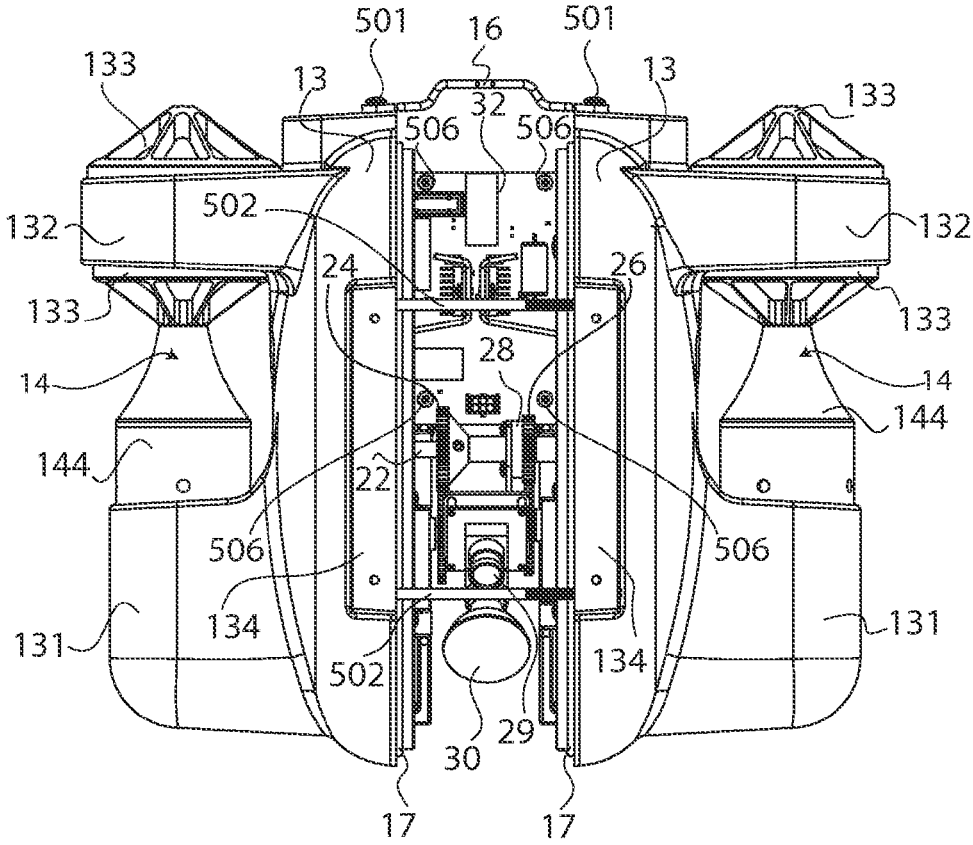
FIG. 7 is a top plan view of the present invention excluding the viewing window to show the internal body.

As shown in FIG. 7, the present invention utilizes the video camera 30 and the flood light 29 to help the user to navigate the submersible underwater. The video camera 30 and the flood light 29 are mounted onto the camera arm mount 31. The camera arm mount 31 is extended out from the center shaft 22 by the camera arm 27. The camera arm 27 is mounted to and is able to pivot about the center shaft 22 by the camera shaft mount 28. The user is able to control the viewing direction of the video camera 30 and flood light 29 independently from the angle of pitch by the camera servo motor 25. The camera servo motor 25 is fastened onto the camera servo mount 212 by camera servo fasteners 505. The camera servo motor 25 is connected to the camera shaft mount 28 by means of the camera train 26 in a pivoting manner, similar to the pitch shaft train 24 to the center shaft 22. The camera train 26 allows rotational forces to be transferred to the camera shaft mount 28 for the independent pivoting of the video camera 30 and the flood light 29 about the center shaft 22. This video camera 30 and flood light 29 mechanism allows the user more freedom in observing the submersible's surroundings. The video camera 30 also serves to allow the users to see objects ahead for navigation and control of the submersible. The flood light 29 serves to illuminate the path that the submersible is taking and the areas the video camera 30 is displaying to the user. The submersible makes use of the battery pack 33 to power the video camera 30, the flood light 29, the thrusters 14, the pitch servo motor 23, and the camera servo motor 25. The battery pack 33 is positioned on and secured to the battery mount 214 of the internal frame 21. To ensure that the center of gravity for the internal body 2 is centered, the internal frame 21 will have a battery mount 214 on the left and right side. By mounting battery packs 33 on both the left and right side, there is no unutilized space within the external body 1. Attached with the battery pack 33 are the weight sets 34. The weight sets 34 serve to add additional mass to the submersible to ensure that the mass of the submersible is equal to the mass of the volume of water the submersible is displacing. This ensures that the submersible possesses neutral buoyancy so the submersible will not need to continually work against vertical forces to hold a depth.

In reference to FIG. 6, FIGS. 7, and 9, all of the components of the submersible including the thrusters 14, the pitch servo motor 23, the camera servo motor 25, the video camera 30, and the flood light 29 are connected and controlled by the control circuit 32. These components are similarly powered by means of the control circuit 32 as the battery pack 33 is connected and acts as a power source for the control circuit 32. However, although the control circuit 32 is able to control all of the electronics of the submersible, the commands and signals are relayed to the control circuit 32 by the control tether port 12. The operator makes use of a game pad controller to relay commands and signals to the control circuit 32 through the control tether 7. This allows the user to remotely adjust the direction of the video camera 30 and the flood light 29, thrust the submersible forward, thrust the submersible in reverse, adjust the angle of pitch for the submersible, adjust the amount of thrust between the thrusters 14 for turning. Additionally, the charge port 11 is connected to the control circuit 32 to allow for connection of a smart charger 6 to charge the battery packs 33 when the submersible is not in use. The control circuit 32 is fastened onto the circuit board mount 211 on the internal frame 21 by circuit board fasteners 506.

Figure 12:
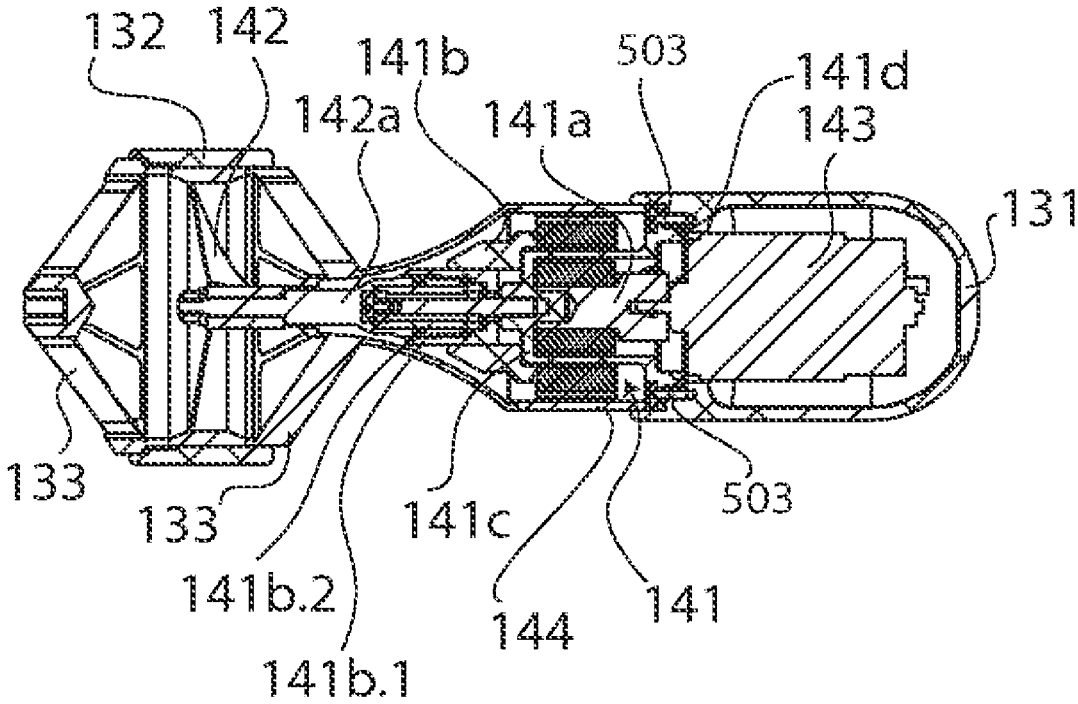
FIG. 12 is a right side view of the thruster showing the components and mechanisms involved with the thrusters. The heavily shaded area represents the magnets in the magnetic coupling. The magnets are arranged in the coupling within the follower and the driver in a similar fashion to a bullet and revolver design. This type of design does not require the use of customized shaped magnets or any special glue to hold the magnets in place.

In reference to FIG. 12, the present invention makes use of two independently controlled thrusters 14 for propulsion. The thrusters 14 comprise of a magnetic couple 141, a propeller 142, a driving motor 143, and a shaft coupling cover 144. The thrusters 14 are located at the sides of the shell bodies 13 on the XY plane parallel with the roll axis of the submersible. The thrusters 14 are inserted and secured onto the thruster mount 131. The thruster mount 131 is a protruding cup-like structure that is protruding laterally from the shell bodies 13. The thruster mount 131 is arranged horizontally and centered, having the opening face the rear of the submersible. On the inside of the cup is a hole leading into the interior spacing of the shell bodies 13 and the viewing window 15. The driving motor 143 is the portion of the thrusters 14 that will be inserted and sealed within the thruster mount 131. The hole leading into the interior space allows the driving motor 143 to be connected to the control circuit 32 for powering and control. However, the presence of this hole requires the connection of the thrusters 14 into the thruster mount 131 to be sealed water tight. For the purpose of ensuring that the thruster mount 131 is sealed from the exterior, the thruster utilizes the magnetic couple 141 for propulsion of the propeller 142. The magnetic couple 141 comprises of a driver 141*a*, a follower 141*b*, a barrier 141*c*, and a thruster sealing o-ring 141*d*. The driver 141*a* is connected directly to the driving motor 143 and protrudes out of the thruster mount 131 in a conical shaped manner. To seal the thruster mount 131 completely, the barrier 141*c* is fastened to the thruster mount 131 by thruster fasteners 503. The barrier 141*c* will completely cover and seal the driving motor 143 and the driver 141*a* within the thruster mount 131. To further ensure that thruster 14 is sealed water tight, the thruster sealing o-ring 141*d* is positioned between the barrier 141*c* and the thruster mount 131. The barrier 141*c* similar to the drive possesses a protruding conical shape. The follower 141*b* envelopes the barrier 141*c* and is able to pivot about the barrier 141*c*. The driver 141*a* and the follower 141*b* are able to couple by magnetic force through the barrier 141*c*. While the driving motor 143 is physically rotating the driver 141*a*, the follower 141*b* is able to rotate along with the driver 141*a* without the need of physical connection by means of magnetic force. The propeller 142 is able to protrude and extend out from the thruster 14 by means of a propeller shaft 142*a*. However, for connection of the propeller 142 to the thrusters 14, the follower 141*b* comprises of a propeller water bearing housing 141*b*.1 and a static o-ring seal 141*b*.2. The propeller shaft 142*a* is secured onto the propeller water bearing housing 141*b*.1 and extends the propeller 142 towards the rear of the submersible. The propeller water bearing housing 141*b*.1 is an oil compensated underwater bearing, that further comprises of two small ball bearings, a oil/grease chamber, and is sealed from the water by a rotary shaft seal and the static o-ring seal 141*b*.2. This allows the propeller 142 to spin freely with little drag. The propeller 142 is enveloped and protected by the propeller guarding collar 132. The propeller guarding collar 132 is a laterally protruding tubular structure positioned towards the rear of the shell bodies 13 to prevent the propeller 142 from impacting any hard surfaces such as rocks or coral under water. To ensure secure fastening of the propeller shaft 142*a*, the static o-ring seal 141*b*.2 is positioned within and between the propeller water bearing housing 141*b*.1 and the propeller shaft 142*a*. The shaft and the follower 141*b* are covered and secured onto the thruster 14 by the shaft coupling cover 144. The shaft coupling cover 144 is a funnel type structure that envelops the propeller shaft 142*a* and the follower 141*b*. The propeller 142 is enclosed within the propeller guarding collar 132 by the propeller guards 133. The propeller guards 133 are ribbed structures that prevent anything from getting caught in the rotating propeller 142 while still allowing the propeller 142 to catch water for propulsion.

Figure 8:
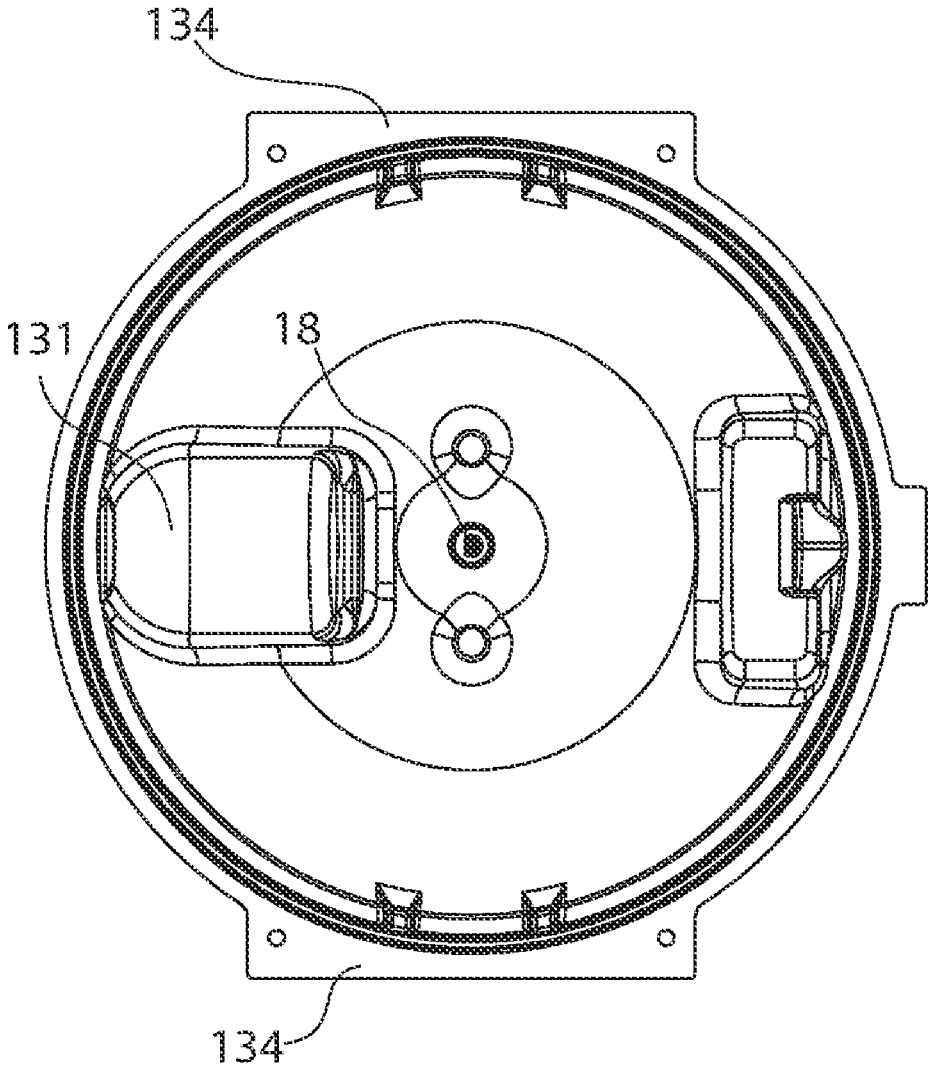
FIG. 8 is the inside side view of the shell bodies showing the first center of gravity of the external body.

In reference to FIG. 2 and FIG. 3, the present invention is a submersible vehicle with a circular profile that is able to achieve stability with its design. The present invention makes use of the configuration of the external body 1 and the internal body 2 to control the submersible COG 4 and the COB 3. When treating the external body 1 and the internal body 2 as separate entities, as shown in FIG. 8 and FIG. 9, the first COG 18 of the external body 1 closely coincides with the COB 3. With the first COG 18 coinciding with the COB 3 near or on the center axis of the circular profile of the external body 1, the external body 1 is unstable and will be unable to maintain a steady level of control. With little to no distance between the first COG 18 and the COB 3 an effective righting moment cannot be created regardless of what orientation the submersible is in. The advantage of this configuration is that external forces can work to reposition the external body 1 without a righting moment working against it. The second COG 35 of the internal body 2 is shown in FIG. 9 at a position well below the center of the present invention. The internal body 2 is positioned within the external body 1. Therefore, the internal body 2 does not possess its own COB 3, as it does not displace water. When the internal body 2 is brought together with the external body 1, the resulting submersible COG 4 is simply a combination of the first COG 18 and the second COG 35 of the separate entities. The COB 3 will remain in the same position because the same amount of water is being displaced. The COB 3 will also remain in the same position regardless of the pitch of the submersible due to its position on the pitch center of axis. Due to a lower second COG 35 of the internal body 2, the submersible COG 4 of the combined bodies pulls the overall COG down away from the COB 3 and in turn allows the present invention to gain stability.

To control the submersible remotely, the present invention also comprises of a buoyancy weight set 5, a smart charger 6, a control tether 7, a game pad controller 8, a pair of video glasses 9, and a video receiver 10. The buoyancy weight set 5 is an optional addition that is able to fasten onto the sealing fastener ports 134. The buoyancy weight set 5 allows users to fine tune the submersible to gain the desired center of buoyancy 3. This may be needed with using the submersible between fresh water and sea water. There is approximately 3% deviation of density between the two types of waters. The buoyancy weight set allows the user to account for this deviation when using the submersible in both types of waters. To charge the battery packs 33 of the submersible the user can attach the smart charger 6 to the charge port 11. The control tether 7 is a long cable that connects the game pad controller 8 with the submersible at the control tether port 12. Additionally the control tether 7 serves to stream video from the submersible to the game pad controller 8. The video receiver 10 is connected to the game pad controller 8 and connected to the pair of video glasses 9. By using the pair of video glasses 9, the user will be able to see what the submersible sees and control the submersible remotely with the game pad controller 8.

Although the invention has been explained in relation to its preferred embodiment, it is to be understood that many other possible modifications and variations can be made without departing from the spirit and scope of the invention as hereinafter claimed.

What is claimed is:

1. A Remotely Operated Submersible Vehicle comprises, an external body comprising a charge port, a center shaft, a control tether port, shell bodies, thrusters, a viewing window, a tether support, and window sealing o-rings;

an internal body comprising of an internal frame, a pitch servo motor, a pitch shaft train, a camera servo motor, a camera train, a camera arm, a camera shaft mount, a flood light, a video camera, a camera arm mount, a control circuit, battery packs, and weight sets;

the remotely operated submersible vehicle having a center of buoyancy;

the external body having a first center of gravity positioned at a same location as the center of buoyancy;

the internal body having a second center of gravity fixed and vertically downward in relation to the center of buoyancy regardless of pitch orientation of the external body; and the remotely operated submersible vehicle having a center of gravity determined by the first center of gravity and the second center of gravity on basis of weights of the external body and the internal body.

2. The Remotely Operated Submersible Vehicle as claimed in claim 1 comprises, the shell bodies having a circular profile and comprising of a thruster mount, a propeller guarding collar, propeller guards, and sealing fastener ports;

each of the thrusters comprising of a magnetic couple, a propeller, a driving motor, and a shaft coupling cover;

the thruster mount being laterally protruded, vertically centered and arranged in horizontal relationship to the shell bodies;

the thrusters being inserted into the thruster mount;

the propeller protruding from the thruster mount by a propeller shaft and being enveloped by the propeller guarding collar;

the magnetic couple comprising of a driver, a follower, a barrier, and a thruster sealing o-ring;

the thruster being secured onto the thruster mount at the barrier by thruster fasteners; and the thruster sealing o-ring being positioned between the thruster mount and the barrier preventing water leakage into the remotely operated submersible.

3. The Remotely Operated Submersible Vehicle as claimed in claim 1 comprises, the internal frame comprises of a circuit board mount, a camera servo mount, a pitch servo mount, a battery mount, a mechanical stop, and a shaft frame mount;

the internal frame hanging downwardly from and being able to pivot about the center shaft by the shaft frame mount;

the center shaft connected and positioned in concentric relationship to the shell bodies;

the pitch servo motor being secured onto the pitch servo mount by pitch servo fasteners; and the pitch servo motor being connected to the center shaft by the pitch shaft train.

4. The Remotely Operated Submersible Vehicle as claimed in claim 2 comprises, the viewing window being a transparent tubular structure of equal radius relative to the shell bodies;

the viewing window being positioned between the shell bodies;

the window sealing ring being positioned between and sealing the shell bodies with the viewing window; and the shell bodies and the viewing window being fastened together at the sealing fastener ports by sealing fasteners.

5. The Remotely Operated Submersible Vehicle as claimed in claim 2 comprises, the driver being connected to the driving motor and sealed within the thruster mount by the barrier and the thruster sealing o-ring;

the driver being enveloped by the barrier;

the driving motor being connected to the control circuit and sealed within the thruster mount;

the follower comprises of a propeller water bearing housing and a static o-ring seal;

the follower enveloping the barrier;

the propeller shaft being fastened onto the propeller water bearing housing;

the static o-ring seal being positioned between the propeller shaft and propeller water bearing housing;

the shaft coupling cover enveloping the follower and the propeller shaft; and the propeller guards being ribbed structures enclosing the propeller in the propeller guarding collar.

6. The Remotely Operated Submersible Vehicle as claimed in claim 4 comprises, the charge port being positioned adjacent to propeller guarding collar and the viewing window;

the control tether port being positioned adjacent to the propeller guarding collar and the viewing window; and the tether support being fastened to shell bodies by tether support fasteners and positioned between the charge port and the control tether port.

7. The Remotely Operated Submersible Vehicle as claimed in claim 3 comprises, the control circuit being fastened to the circuit board mount by circuit board fasteners;

the battery pack and the weight set being secured onto the battery mount;

the thrusters being connected to the control circuit;

the video camera being connected to the control circuit;

the flood light being connected to the control circuit;

the pitch servo motor being connected to the control circuit;

the camera servo motor being connected to the control circuit;

the charge port being connected to the control circuit;

the control tether port being connected to the control circuit; and the battery pack being connected and providing power to the control circuit.

8. The Remotely Operated Submersible Vehicle as claimed in claim 3 comprises, the camera servo motor being fastened onto the camera servo mount by camera servo fasteners;

the camera shaft mount connected to and being able to pivot about the center shaft;

the camera arm being connected to the camera mount;

the camera servo motor being connected to the camera shaft mount by the camera train;

the flood light and the video camera being fastened onto the camera arm by the camera arm mount; and the camera train being an angular motion transferring mechanism selected from the group consisting of a gear set, a belt and pulley system, or a chain and sprocket system.

9. The Remotely Operated Submersible Vehicle as claimed in claim 6 comprises, a buoyancy weight set;

a charging device;

a control tether;

a game pad controller;

a pair of video glasses; and a video receiver.

10. A Remotely Operated Submersible Vehicle comprises, an external body comprising a charge port, a center shaft, a control tether port, shell bodies, thrusters, a viewing window, a tether support, and window sealing o-rings;

an internal body comprising of an internal frame, a pitch servo motor, a pitch shaft train, a camera servo motor, a camera train, a camera arm, a camera shaft mount, a flood light, a video camera, a camera arm mount, a control circuit, battery packs, and weight sets;

the remotely operated submersible vehicle having a center of buoyancy;

the external body having a first center of gravity positioned at a same location as the center of buoyancy;

the internal body having a second center of gravity fixed and vertically downward in relation to the center of buoyancy regardless of pitch orientation of the external body;

the remotely operated submersible vehicle having a center of gravity determined by the first center of gravity and the second center of gravity on basis of weights of the external body and the internal body;

the shell bodies having a circular profile and comprising of a thruster mount, a propeller guarding collar, propeller guards, and sealing fastener ports;

each of the thrusters comprising of a magnetic couple, a propeller, a driving motor, and a shaft coupling cover;

the thruster mount being laterally protruded, vertically centered and arranged in horizontal relationship to the shell bodies;

the thrusters being inserted into the thruster mount;

the propeller protruding from the thruster mount by a propeller shaft and being enveloped by the propeller guarding collar;

the magnetic couple comprising of a driver, a follower, a barrier, and a thruster sealing o-ring;

the thrusters being secured onto the thruster mount at the barrier by thruster fasteners;

the thruster sealing o-ring being positioned between the thruster mount and the barrier preventing water leakage into the remotely operated submersible;

the internal frame comprises of a circuit board mount, a camera servo mount, a pitch servo mount, a battery mount, a mechanical stop, and a shaft frame mount;

the internal frame hanging downwardly from and being able to pivot about the center shaft by the shaft frame mount;

the center shaft connected and positioned in concentric relationship to the shell bodies;

the pitch servo motor being secured onto the pitch servo mount by pitch servo fasteners; and the pitch servo motor being connected to the center shaft by the pitch shaft train.

11. The Remotely Operated Submersible Vehicle as claimed in claim 10 comprises, the viewing window being a transparent tubular structure of equal radius relative to the shell bodies;

the viewing window being positioned between the shell bodies;

the window sealing ring being positioned between and sealing the shell bodies with the viewing window; and the shell bodies and the viewing window being fastened together at the sealing fastener ports by sealing fasteners.

12. The Remotely Operated Submersible Vehicle as claimed in claim 10 comprises, the driver being connected to the driving motor and sealed within the thruster mount by the barrier and the thruster sealing o-ring;

the driver being enveloped by the barrier;

the driving motor being connected to the control circuit and sealed within the thruster mount;

the follower comprises of a propeller water bearing housing and a static o-ring seal;

the follower enveloping the barrier;

the propeller shaft being fastened onto the propeller water bearing housing;

the static o-ring seal being positioned between the propeller shaft and propeller water bearing housing;

the shaft coupling cover enveloping the follower and the propeller shaft; and the propeller guards being ribbed structures enclosing the propeller in the propeller guarding collar.

13. The remotely operated submersible vehicle as claimed in claim 10 comprises, the control circuit being fastened to the circuit board mount by circuit board fasteners;

the battery pack and the weight set being secured onto the battery mount;

the thrusters being connected to the control circuit;

the video camera being connected to the control circuit;

the flood light being connected to the control circuit;

the pitch servo motor being connected to the control circuit;

the camera servo motor being connected to the control circuit;

the charge port being connected to the control circuit;

the control tether port being connected to the control circuit; and the battery pack being connected and providing power to the control circuit.

14. The Remotely Operated Submersible Vehicle as claimed in claim 10 comprises, the camera servo motor being fastened onto the camera servo mount by camera servo fasteners;

the camera shaft mount connected to and being able to pivot about the center shaft;

the camera arm being connected to the camera mount;

the camera servo motor being connected to the camera shaft mount by the camera train;

the flood light and the video camera being fastened onto the camera arm by the camera arm mount; and the camera train being a pivoting motion transferring mechanism selected from the group consisting of a gear set, a belt and pulley system, or a chain and sprocket system.

15. The remotely operated submersible vehicle as claimed in claim 11 comprises, the charge port being positioned adjacent to propeller guarding collar and the viewing window;

the control tether port being positioned adjacent to the propeller guarding collar and the viewing window;

the tether support being fastened to shell bodies by tether support fasteners and positioned between the charge port and the control tether port;

a buoyancy weight set;

a charging device;

a control tether;

a game pad controller;

a pair of video glasses; and a video receiver.

16. A Remotely Operated Submersible Vehicle comprises, an external body comprising a charge port, a center shaft, a control tether port, shell bodies, thrusters, a viewing window, a tether support, and window sealing o-rings;

an internal body comprising of an internal frame, a pitch servo motor, a pitch shaft train, a camera servo motor, a camera train, a camera arm, a camera shaft mount, a flood light, a video camera, a camera arm mount, a control circuit, battery packs, and weight sets;

the remotely operated submersible vehicle having a center of buoyancy;

the external body having a first center of gravity positioned at a same location as the center of buoyancy;

the internal body having a second center of gravity fixed and vertically downward in relation to the center of buoyancy regardless of pitch orientation of the external body;

the remotely operated submersible vehicle having a center of gravity determined by the first center of gravity and the second center of gravity on basis of weights of the external body and the internal body;

the shell bodies having a circular profile and comprising of a thruster mount, a propeller guarding collar, propeller guards, and sealing fastener ports;

each of the thrusters comprising of a magnetic couple, a propeller, a driving motor, and a shaft coupling cover;

the thruster mount being laterally protruded, vertically centered and arranged in horizontal relationship to the shell bodies;

the thrusters being inserted into the thruster mount;

the propeller protruding from the thruster mount by a propeller shaft and being enveloped by the propeller guarding collar;

the magnetic couple comprising of a driver, a follower, a barrier, and a thruster sealing o-ring;

the thrusters being secured onto the thruster mount at the barrier by thruster fasteners;

the thruster sealing o-ring being positioned between the thruster mount and the barrier preventing water leakage into the remotely operated submersible;

the internal frame comprises of a circuit board mount, a camera servo mount, a pitch servo mount, a battery mount, a mechanical stop, and a shaft frame mount;

the internal frame hanging downwardly from and being able to pivot about the center shaft by the shaft frame mount;

the center shaft connected and positioned in concentric relationship to the shell bodies;

the pitch servo motor being secured onto the pitch servo mount by pitch servo fasteners;

the pitch servo motor being connected to the center shaft by the pitch shaft train;

the viewing window being a transparent tubular structure of equal radius relative to the shell bodies;

the viewing window being positioned between the shell bodies;

the window sealing ring being positioned between and sealing the shell bodies with the viewing window;

the shell bodies and the viewing window being fastened together at the sealing fastener ports by sealing fasteners;

the camera servo motor being fastened onto the camera servo mount by camera servo fasteners;

the camera shaft mount connected to and being able to pivot about the center shaft;

the camera arm being connected to the camera mount; and the camera servo motor being connected to the camera shaft mount by the camera train.

17. The Remotely Operated Submersible Vehicle as claimed in claim 16 comprises, the charge port being positioned adjacent to propeller guarding collar and the viewing window;

the control tether port being positioned adjacent to the propeller guarding collar and the viewing window;

the tether support being fastened to shell bodies by tether support fasteners and positioned between the charge port and the control tether port;

a buoyancy weight set;

a charging device;

a control tether;

a game pad controller;

a pair of video glasses; and a video receiver.

18. The Remotely Operated Submersible Vehicle as claimed in claim 16 comprises, the driver being connected to the driving motor and sealed within the thruster mount by the barrier and the thruster sealing o-ring;

the driver being enveloped by the barrier;

the driving motor being connected to the control circuit and sealed within the thruster mount;

the follower comprises of a propeller water bearing housing and a static o-ring seal;

the follower enveloping the barrier;

the propeller shaft being fastened onto the propeller water bearing housing;

the static o-ring seal being positioned between the propeller shaft and propeller water bearing housing;

the shaft coupling cover enveloping the follower and the propeller shaft; and the propeller guards being ribbed structures enclosing the propeller in the propeller guarding collar.

19. The Remotely Operated Submersible Vehicle as claimed in claim 16 comprises, the control circuit being fastened to the circuit board mount by circuit board fasteners;

the battery pack and the cast weight set being secured onto the battery mount;

the thrusters being connected to the control circuit;

the video camera being connected to the control circuit;

the flood light being connected to the control circuit;

the pitch servo motor being connected to the control circuit;

the camera servo motor being connected to the control circuit;

the charge port being connected to the control circuit;

the control tether port being connected to the control circuit; and the battery pack being connected and providing power to the control circuit.

20. The Remotely Operated Submersible Vehicle as claimed in claim 16 comprises, the flood light and the video camera being fastened onto the camera arm by the camera arm mount; and the camera train being an angular motion transferring mechanism selected from the group consisting of a gear set, a belt and pulley system, or a chain and sprocket system.

* * * * *